United States Patent [19]

Muzhzhavlev et al.

[11] 4,058,448

[45] Nov. 15, 1977

[54] DIAPHRAGMLESS ELECTROLYZER FOR PRODUCING MAGNESIUM AND CHLORINE

[76] Inventors: Konstantin Dmitrievich Muzhzhavlev, Zheleznovodskaya ulitsa, 48, kv. 30; Sergei Petrovich Kosarev, Nalichnaya ulitsa, 39, korpus 1, kv. 20; Vladimir Ivanovich Schegolev, ulitsa Krasnaya, 50, kv. 30; Andrei Borisovich Ivanov, prospekt Smirnova, 59, kv. 151, all of Leningrad; Oleg Nikolaevich Romanenko, ulitsa Sevastopolskaya, 6, kv. 46, Kalush Ivano-Frankovskoi oblasti; Vladimir Dmitrievich Yazev, ulitsa Mira, 44, kv. 1, Solikamsk Permskoi oblasti; Alexei Vasilievich Vasiliev, ulitsa Bogdana Khmelnitskogo, 66, kv. 57, Kalush Ivano-Frankovskoi oblasti, all of U.S.S.R.

[21] Appl. No.: 698,936

[22] Filed: June 23, 1976

[51] Int. Cl.[2] ..... C25C 3/04; C25C 3/08

[52] U.S. Cl. ..... 204/244; 204/70; 204/245; 204/247

[58] Field of Search ..... 204/243–247, 204/70

[56] References Cited

U.S. PATENT DOCUMENTS

| | | | |
|---|---|---|---|
| 3,907,651 | 9/1975 | Andreassen et al. | 204/245 X |

FOREIGN PATENT DOCUMENTS

| | | | |
|---|---|---|---|
| 2,459,930 | 7/1975 | Germany | 204/243 R |
| 246,070 | 11/1969 | U.S.S.R. | 204/243 R |
| 259,398 | 4/1970 | U.S.S.R. | 204/243 R |
| 290,954 | 3/1971 | U.S.S.R. | 204/245 |

*Primary Examiner*—John H. Mack
*Assistant Examiner*—D. R. Valentine
*Attorney, Agent, or Firm*—Lackenbach, Lilling & Siegel

[57] ABSTRACT

The electrolyzer has a refractory-lined hollow shell divided into a group of electrolytic cells and a magnesium collecting cell by a vertical separator plate that is shorter than the shell. Steel cathodes shaped as frames embrace a graphite anodes arranged in groups. To convey magnesium from the electrolytic cells into a magnesium collecting cell, at least two passageways are provided, each of them being substantially at right angles to the graphite anodes and to the separator plate. The separator plate has through perforations situated below the electrolyte level. Each of the passageways is confined between the wall of the electrolyzer shell and the portion of the cathode that faces towards the magnesium collecting cell. The width of each of the magnesium conveyance passageways is a maximum of three times the width of the gap across the adjacent graphite anode and steel cathode in each electrolytic cell.

8 Claims, 9 Drawing Figures

DIAPHRAGMLESS ELECTROLYZER FOR PRODUCING MAGNESIUM AND CHLORINE

The present invention relates to diaphragmless electrolyzers for producing magnesium and chlorine, and is usable in the metallurgical industry, wherein there is electrolyzed melts containing a mixture of magnesium-, sodium-, potassium- and calcium chlorides.

In present-day practice diaphragm electrolyzers are in widespread use for producing magnesium and chlorine.

A diaphragm electrolyzer for producing magnesium and chlorine comprises a refractory-lined metal shell and a cover in the form of a row of plates resting upon the longitudinal walls of the cell and spaced somewhat apart from one another. Graphite anodes shaped as rectangular plates are passed through each of the cover plates which are arranged parallel to the end walls of the electrolyzer shell and secured on the longitudinal walls thereof. Each of the cathodes is made as steel plates sunk by two into the space between the adjacent cover plates and each of the steel plates is so spaced apart from the adjacent graphite anode as to define an interelectrode distance therebetween. The gaps between the adjacent steel cathodes, and those between the cathodes and the cover plates are covered by lids. Between every anode and steel cathode plate there are vertical partitions called diaphragms adjoining the plates of the cover and longitudinal walls of the shell and being too short to reach the bottom.

Thus, every two adjacent electrolytic cells are divided by the diaphragm into the anode space confined within the two adjacent diaphragms, the electrolyte face and the cover plates, and the cathode space enclosed likewise within the two adjacent diaphragms, the electrolyte face and the lids.

Chlorine evolving in the course of electrolysis on the graphite anodes is confined in the anode spaces and discharged through the outlet nozzles provided on the electrolyzer shell.

Magnesium is liberated during electrolysis on the steel cathodes, and then emerges to the electrolyte surface in each of the cathode spaces. As fast as it accumulates magnesium is extracted by a vacuum scoop or by any other known contrivance suitable for the purpose.

The merit of diaphragm-type electrolyzers lies with the fact that the width of graphite anodes and steel cathodes exerts no substantial influence upon the current yield of that metal and can reach three meters and over.

This feature enables diaphragm electrolyzers rated at a current intensity of 200 kA and over with a relatively small number of anodes and cathodes ranging from 7 to 10 to be used.

Notwithstanding the above merit, diaphragm electrolyzers fail to meet the modern requirements of industry, the reason being as follows.

Diaphragm electrolyzers feature a low yield of magnesium per unit area of the cell bottom which accounts for the presence of a great number of diaphragms and the necessity of accordingly having a large number of anode and cathode spaces.

The known electrolyzers suffer from too high a specific power consumption amounting to 15.5–17.5 thousand kilowatt-hours per ton of magnesium yielded, and also from considerable losses of chlorine.

Moreover, much chlorine gets into the cathode spaces, thus becoming diluted there with atmospheric air leaking in when opening the lids.

Losses of chlorine in diaphragm electrolyzers amount to as high as 300–400 kg per ton of magnesium.

Utilization of air-diluted chlorine is very expensive to carry out.

Diaphragm electrolyzers have high maintenance expenses called forth by the necessity to extract magnesium in a great many of places.

Chlorine penetrating into the cathode spaces is liable to escape into the atmosphere when opening the lids for the magnesium to extract, thus adversely affecting labor conditions for the electrolyzer attending personnel.

Diaphragmless electrolyzers have gained extensive application for the past time.

A diaphragmless electrolyzer comprises a refractory-lined shell having longitudinal (side) walls and butt ends, a bottom, a covering and at least one vertical separator plate adjacent to the walls and being shorter than the shell.

The separator plate divides the electrolyzer interior into the magnesium collecting cell and a group of electrolytic cells, in which group each of the graphite anodes is made as a rectangular plate and the steel cathode is frame-shaped to form a closed circuit with a gap between the frame and each of the graphite anodes.

Electrolytic cells are defined between the graphite anodes and the adjacent steel cathodes. The graphite anodes and steel cathodes are fixed in position on the walls of the electrolyzer shell.

The heretofore available diaphragmless electrolyzers are known to comprise at least one group of electrolytic cells and one cell on which the magnesium collects.

To discharge chlorine from the electrolyzer, an outlet nozzle is provided, communicating with the space between the covering and the electrolyte face in the group of electrolytic cells. A lid is provided over the magnesium-collecting cell with an outlet for sanitary exhaustion of gases.

In such a diaphragmless electrolyzer the graphite anodes are plate-shaped and are arranged square with the separator plate isolating the group of electrolytic cells from the magnesium-collecting cell. Magnesium formed in each of the anode-to-cathode spaces is extracted only towards the separator plate. In the opposite direction the interelectrode distances practically adjoin the shell walls so that magnesium extraction therefrom into the collecting cell is impeded.

With such an arrangement of the graphite anodes and steel cathodes with respect to the separator plate, active electrolyte circulation occurs within the zone of the separator plate which leads to a blow-out of chlorine from under the separator plate into the magnesium-collecting cell and a repeated return of magnesium from that cell into the electrolytic cells, wherein electrolyte is chlorine-saturated.

When returned into the interelectrode spaces, magnesium is chlorinated, and an additional amount of power is required for a repeated electrowinning thereof.

The current yield in such a diaphragmless electrolyzer is as low as 76 to 80 percent, the specific power consumption per ton of magnesium amounts to 14 thousand kilowatts, while losses of chlorine along with sanitation exhaust gases account for 150 to 180 kg per ton of magnesium.

The aforesaid diaphragmless electrolyzers are advantageous over diaphragm-type electrolyzers in having better economical characteristics and requiring less specific labor consumption for magnesium and mud extraction.

However, a further rise of productive efficiency of said known diaphragmless electrolyzer and an increase of current intensity used therein is possible only by adding to the number of graphite anodes. Besides, unidirectional magnesium extraction from the interelectrode spaces restricts the width of the graphite anodes to as little as 1.5–1.8 m.

If the width of the graphite anodes exceeds that mentioned above, the length of the path for magnesium conveyance towards the separator plate through the bulk of chlorine-saturated electrolyte is substantially increased. This results in losses of magnesium due to its chlorination and reduces the current yield to 70–55 percent.

The diaphragmless electrolyzer of such a construction rated at 180–200 kA comprises 20 to 30 graphite anodes. Such a great number of graphite anodes complicates the electrolyzer construction and involves much labor to replace graphite anodes which calls forth higher losses of chlorine into the shop's atmosphere and heat losses.

All this adversely affects economical characteristics of electrolyzers when their productive efficiency is raised.

Current magnitude in such electrolyzers is limited to 180–200 kA, and preferably to 100–150 kA.

In some other of the known diaphragmless electrolyzers, with a view to reducing losses of chlorine and magnesium and increasing current intensity without complicating the construction thereof, the separator plate isolating the group of electrolytic cells from the magnesium collecting cell is arranged parallel to the graphite anodes.

In this case to withdraw magnesium from the interelectrode spaces use is made of chutes or troughs of various construction.

However this method failed to raise the efficiency of the electrolyzer or to cut specific power consumption and led to an increase in chlorine losses and a reduction of the electrolyzer service life and current efficiency due to introducing into the electrolyzer some additional qualities of iron.

As mechanical engineering practice develops, demand for metal rises more and more thus necessitating lower production cost thereof.

Inasmuch as the heretofore-known electrolyzers for producing magnesium and chlorine failed to meet ever-growing requirements as to their operating efficiency, a need arose in improving the construction and efficiency thereof.

It is a primary object of the present invention to provide a diaphragmless electrolyzer for producing magnesium and chlorine that would feature higher economical characteristics as compared to diaphragmless electrolyzers of the same purpose, known heretofore.

It is another and equally important object of the present invention to provide a diaphragmless electrolyzer that would make it possible to increase its productive efficiency by two or three times as compared to the same diaphragmless electrolyzers known heretofore.

Not less important is one more object of the present invention to improve labor conditions for attending personnel.

A further important object of the present invention is to reduce maintenance expenses of such an electrolyzer and to prolong service life thereof.

These and other objects are accomplished in a diaphragmless electrolyzer for producing magnesium and chlorine, comprising a refractory-lined shell with a chlorine discharge outlet and at least one vertical separator plate adjacent to the cover and walls thereof but being shorter than the cell, said separator plate having through perforations located below the electrolyte level and adapted to communicate the magnesium collecting cell with a group of electrolytic cells, wherein the steel cathode is shaped as a frame which forms a closed circuit with a gap around each of the graphite anodes, which are made as rectangular plates. According to the invention, the electrolyzer has at least two passageways through which to convey magnesium, each of said passageways being arranged substantially square with the graphite anodes and the separator plate, and being confined between the shell wall and the portion of the steel cathode that faces towards the magnesium collecting cell, the width of each of the passageways being a maximum of three times the width of the gap across the adjacent graphite anode and steel cathode in each of the electrolytic cells.

The afore-described arrangement of the graphite anodes and steel cathodes in the electrolyzer proposed in the present invention, as well as separator plates that isolate the magnesium collecting cell from the group of electrolytic cells, makes it possible to provide at least two magnesium conveying passageways therein.

With the provision of such passageways the magnesium-bearing electrolyte is discharged from each of the interelectrode spaces in both directions which to a great extent cuts down the time of its staying in an electrolytic cell. As the isolated magnesium is liable to react with chlorine to render it into magnesium chloride again, it is desirable to disengage it from chlorine as promptly as possible and to make its way to the collecting cell as short as possible.

The required results are attained due to an optimum relationship between the size of the passageways and their arrangement in the electrolyzer.

All this leads to a lower power consumption for magnesium chloride electrolytic decomposition and a higher current yield of magnesium.

Discharging of magnesium from electrolytic cells successively through the passageways and perforations in the separator plate into the magnesium collecting cell establishes circulation of electrolyte that flows from the magnesium collecting cell under the separator plate towards the group of electrolytic cells. This prevents chlorine from getting from said group into the magnesium collecting cell which is of great importance.

Losses of chlorine in such an electrolyzer is much lesser than in the known electrolyzers.

Magnesium discharge from the anode-to-cathode spaces in the two opposite directions, i.e., along two passageways, makes it possible to use graphite anodes as wide as up to 3 m. Wider graphite anodes and steel cathodes can thus be used for electrolyzers of the same productive efficiency, with their number considerably reduced as compared with the known diaphragmless electrolyzers of the same efficiency.

This cuts down maintenance expenses involved in replacement of graphite anodes.

Use of wider graphite anodes in the same quantity as in the known diaphragmless electrolyzers makes it possible to increase the efficiency of the electrolyzer by 50 or 100 percent with its overall dimensions being but slightly larger.

Provision of passageways in a diaphragmless electrolyzer contributes to good contact of electrolyte with the entire surface of steel cathodes and temperature equalization of all its portions. This precludes deformation of steel cathodes and adds to the electrolyzer service life. The width of the passageways through which the magnesium is conveyed from the group of electrolytic cells into the magnesium collecting cell is selected such that the flow velocity of electrolyte and magnesium be high enough for the latter to quickly discharge from the chlorine-saturated zone.

With the passageway width exceeding three interelectrode distances, flow of electrolyte therealong dies out and the passageways become practically stagnant zones, wherein magnesium is liable to accumulate.

Application of wider graphite anodes improves labor conditions as the amount of chlorine free to escape into the shop's atmosphere is reduced due to replacement of a lower number of anodes. Improved labor conditions on such a diaphragmless electrolyzer are due to the fact that magnesium is extracted from a collecting cell that is practically impenetrable by chlorine.

It is preferable that the diaphragmless electrolyzer of the invention has at least one more magnesium conveyance passageway which can be arranged substantially parallel to said passageways and is defined by the steel cathodes of the adjacent groups of electrolytic cells.

Said additional passageway renders it possible to accommodate two groups of electrolytic cells in the diaphragmless electrolyzer of the invention. With the width and number of the graphite anodes and steel cathodes remaining the same for the group of electrolytic cells the productive efficiency of such a diaphragmless electrolyzer can be 1.5 to 2 times as high as in the known diaphragmless electrolyzers. Magnesium extraction from two groups of electrolytic cells into a single magnesium collecting cell cuts down magnesium extraction expenses.

When a number of such diaphragmless electrolyzers are arranged in series, a common front of maintenance of magnesium collecting cells thus results.

It is expedient that each of the magnesium conveyance passageways in the diaphragmless electrolyzer proposed herein be communicated with an extra magnesium collecting cell which can be defined between the electrolyzer shell wall and an additional separator plate.

This applies equally to the additional magnesium collecting passageways that are confined between the steel cathodes.

In such a diaphragmless electrolyzer the efficiency can be increased by 50 or 100 percent due to the higher number of graphite anodes and steel cathodes, while the area of the cell bottom is increased only 1.2 to 1.5 times. At the same time the magnesium yield per unit area of the bottom gets higher, and constructional expenditures per electrolyzer unit are cut down.

It is advisable that a pair of the passageways of one group of electrolytic cells of the diaphragmless electrolyzer of the invention and a pair of the passageways of the other group of electrolytic cells be communicated with a magnesium collecting cell common to both that can be defined by two separator plates situated between the cathodes of the adjacent groups of electrolytic cells.

Such an arrangement of the magnesium collecting cell reduces heat losses in said cell, and is especially preferable for diaphragmless electrolyzers, wherein the magnesium melting point approximates the temperature of electrolyte. With the magnesium collecting cell in such a position solidification of liquid magnesium is precluded.

It is preferable that the pair of the passageways of each group of electrolytic cells in the herein-disclosed diaphragmless electrolyzer be additionally communicated with their particular magnesium collecting cell, each of said cells being established by the corresponding separator plate and the wall of the electrolyzer shell.

This embodiment of the diaphragmless electrolyzer of the invention makes it possible to provide a electrolyzer having a productive efficiency 2 or 2.5 times higher as compared to the known diaphragmless electrolyzers, while the constructional costs thereof rise by only 1.5 to 1.8 times.

Such a diaphragmless electrolyzer features a magnesium yield per unit area of the cell bottom higher than in the known diaphragmless electrolyzers.

It is practicable to arrange the groups of electrolytic cells in the herein-proposed diaphragmless electrolyzer in a row and communicate each pair of the passageways in the group of electrolytic cells to at least one magnesium collecting cell located between the separator plates, said cell being common to said pair of passageways and to the passageways of the adjacent group of electrolytic cells.

Arrangement of a great number of groups of electrolytic cells in a row makes it possible to make the productive efficiency of the diaphragmless electrolyzer 3 to 3.5 times higher.

Higher efficiency of the diaphragmless electrolyzers holds out promise of further improvement in economical characteristics, e.g., lower electric power consumption and less expenditures for their manufacture and maintenance.

It is favorable that the pairs of passageways in the groups of electrolytic cells of the herein-proposed diaphragmless electrolyzer located at extreme ends of a row be also communicated with their own particular cells for magnesium collection, which can be defined by the wall of the electrolyzer shell and the additional separator plate.

The diaphragmless electrolyzer of the invention, wherein numerous groups of electrolytic cells are arranged in a row and wherefrom magnesium is extracted in both directions, can feature an efficiency 3.5 to 4 times as high as that of the known similar electrolyzers, and provides a possibility for further improvement in the economical indices thereof.

It should be taken into consideration that individual magnesium collecting cells formed by the separator plates and the end walls of the electrolyzer shell are in less favorable conditions as to heat losses than the common magnesium collecting cells defined by the separator plates situated between the cathodes of the adjacent groups of electrolytic cells.

To promote a better understanding of the invention, given below are a number of exemplary embodiments of the diaphragmless electrolyzer for producing magnesium chlorine to be read in conjunction with the accompanying drawings, wherein.

Figure 8:
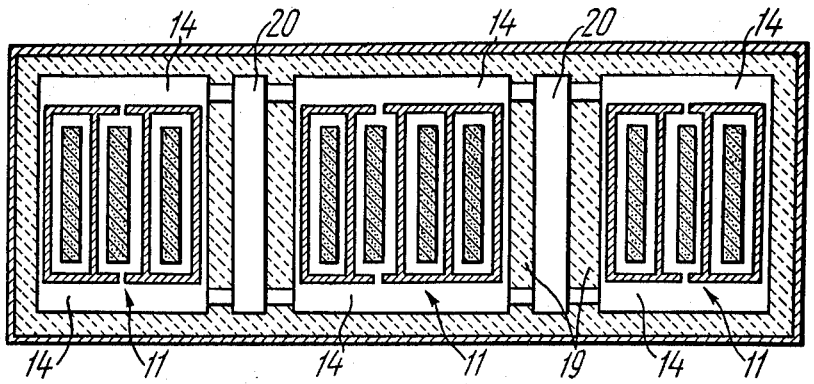
Figure 9:
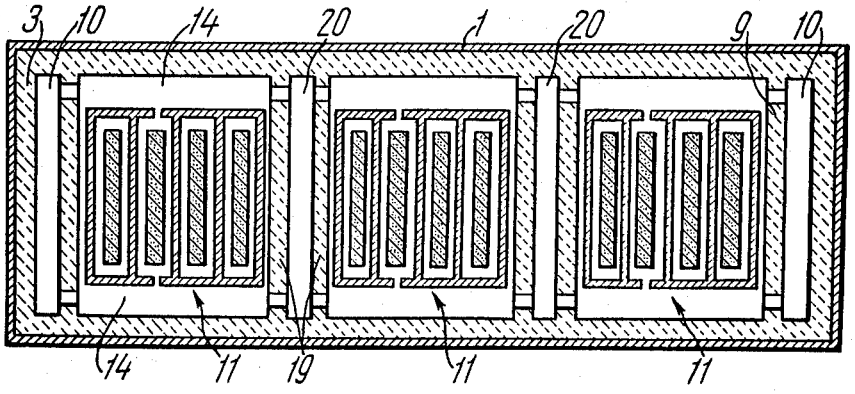

FIG. 8 shows the electrolyzer, wherein each of the pairs of passageways of the row of electrolytic cells communicates with at least one magnesium collecting cell common to it and to the passageways of the adjacent group of electrolytic cells; and FIG. 9 shows the electrolyzer, wherein the extreme pairs of passageways in each row of electrolytic cells communicate with their own particular magnesium collecting cells and with the magnesium collecting cell common to them and to the pair of passageways of the adjacent group of electrolytic cells.

Figure 1:
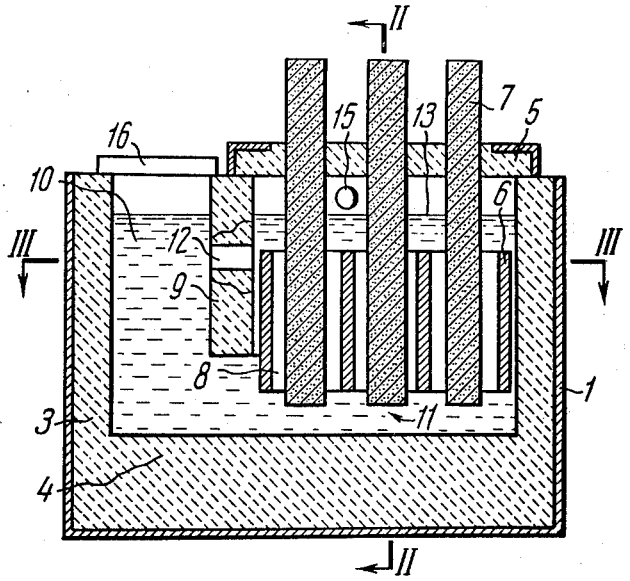
FIG. 1 represents a vertical cross sectional view of a diaphragmless electrolyzer along the longitudinal axis thereof with a fragmentary cutaway at the perforation in the separator plate.
Figure 2:
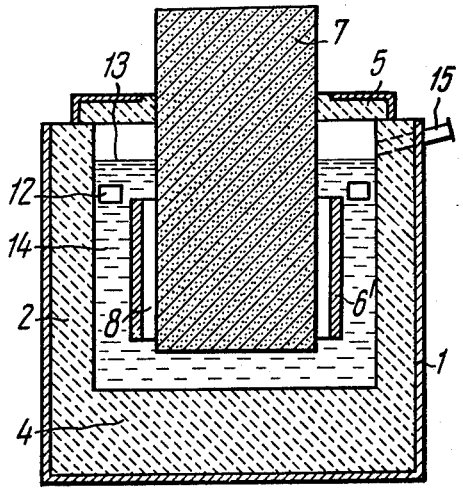
FIG. 2 shows a cross sectional view of the electrolyzer of FIG. 1 taken along the line II—II in FIG. 1.
Figure 3:
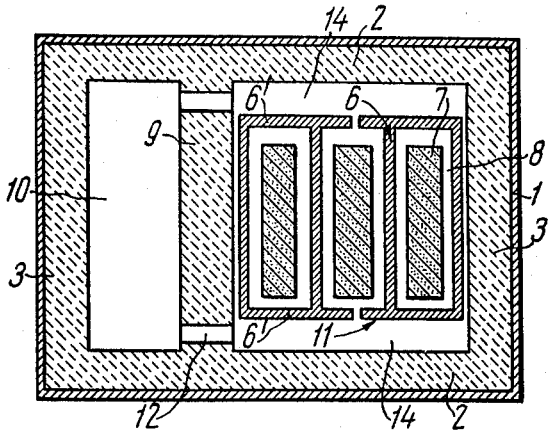
FIG. 3 shows a cross sectional view of the electrolyzer of FIG. 1 taken along the line III—III in FIG. 1.

The diaphragmless electrolyzer for producing magnesium and chlorine according to the invention has a metal shell 1 (FIGS. 1, 2, 3) with longitudinal walls 2 (FIGS. 2, 3), end walls 3 (FIGS. 1, 3), a bottom 4 (FIGS. 1, 2) and a covering 5, all of said components being refractory lined.

The electrolyzer shell 1 carries steel cathodes 6 (FIG. 3), which are shaped as a frame having portions 6' which form an enclosure around each of the graphite anodes 7 (FIG. 2) that are secured on the electrolyzer shell 1, each of the graphite anodes 7 being shaped as a rectangular plate. An annular interelectrode gap 8 is defined between the portions of the steel cathode 6 (FIG. 3) and the graphite anode 7 adjoining each other, said gap being essentially an electrode cell.

A vertical separator plate 9 is accommodated in the electrolyzer compartment, said separator plate being made of a refractory material and being adjacent to the longitudinal walls 2 and the covering 5 (FIG. 1) but being shorter in height than the longitudinal walls 2.

The separator plate 9 isolates a magnesium collecting cell 10 from a group 11 of electrolytic cells confined between the steel cathode 6 and the graphite anodes 7. Through perforations 12 (FIG. 2) are made in the separator plate 9 below the level of an electrolyte 13 in order to place the magnesium collecting cell 10 (FIG. 1) in communication with the group 11 of electrolytic cells.

Two passageways 14 for conveying magnesium from the group 11 of electrolytic cells into the magnesium collecting cell 10 are provided between the portions 6' of the cathodes 6 (FIG. 3) that face towards the magnesium collecting cells 10, the passageways 14 being at substantially right angles to said magnesium collecting cells 10, and the longitudinal walls 2 of the electrolyzer shell.

Said passageways 14 are arranged substantially square with the graphite anodes 7 and the separator plate 9, and the width of each passageway 14 is a maximum of three times the width of the gap 8 (i.e., the interelectrode distance).

A chlorine exhaust outlet 15 is brought into the electrolyzer compartment beneath the covering 5 (FIG. 1) and above the top level of the electrolyte 13 in the group 11 of electrolytic cells, said outlet being fixed in position to the electrolyzer shell 1. The magnesium collecting cell 10 (FIG. 1) is covered with a lid 16.

The diaphragmless electrolyzer according to the invention operates as follows.

The electrolyzer compartment confined within the walls 2 and 3 (FIG. 3) and the bottom (FIG. 1) is filled with the electrolyte 13 which is a molten mixture of magnesium-, sodium-, potassium- and calcium chlorides.

The electrolyte composition is selected such that its specific gravity should exceed that of liquid magnesium, the electrolyte temperature being maintained above the melting point of magnesium.

The molten electrolyte 13 is poured into the compartment inside the shell 1 of the diaphragmless electrolyzer to a level above the top ends of the steel cathodes 6 and the perforations 12 in the separator plate 9. Then electric current is supplied to the steel cathodes 6 and the graphite anodes 7, both of which are electrically connected to the source (not shown) of direct current.

When electric current flows through electrolyte 13 across the interelectrode gap 8, magnesium chloride decomposes to produce gaseous chlorine and yield liquid magnesium.

Chlorine nascent on the graphites anodes 7 ascends to collect under the covering 5, from whence it is discharged through the outlet 15. Magnesium on the steel cathodes 6 is separated therefrom and emerges to the surface of electrolyte 13.

The stream of chlorine passing through the interelectrode gaps 8 induces ascending circulation of electrolyte 13 which contributes to conveying the magnesium-bearing electrolyte into the passageways 14 (FIG. 3) and feeding fresh amounts of electrolyte into the interelectrode gaps 8.

The magnesium-bearing electrolyte is discharged from each of the interelectrode gap 8 into the two passageways 14 at the same time.

The magnesium-saturated electrolyte passes along said passageways 14 towards the separator plate 9 and flows through the perforations 12 in the latter into the magnesium collecting cell 10, wherein magnesium is accumulated on the surface of the electrolyte.

The lower layers of electrolyte 13 without magnesium content moves under the action of the circulating streams under the separator plate 9 from the magnesium collecting cell 10 into the group 11 of electrolytic cells, viz., into the interelectrode gaps thereof. Since the width of the passageways 14 is no more than three times the width of the interelectrode gaps 8, the flow velocity of electrolyte in the passageways is much lower than the flow velocity of electrolyte in electrolytic cells, but it is high enough to convey magnesium to its collecting cell 10.

As magnesium accumulates in the collecting cell 10, the lid 16 is opened and magnesium is periodically extracted by means of a vacuum scoop (not shown), or any other device known to be suitable for the purpose.

As magnesium and chlorine are withdrawn in the course of electrolytic decomposition of magnesium chloride, the level of electrolyte in the electrolyzer compartment drops and the magnesium chloride content in the electrolyte decreases.

To maintain a preset magnesium concentration in the electrolyte and a predetermined electrolyte level in the electrolyzer compartment, a molten mixture of chlorides is periodically added to the latter.

The provision of the magnesium conveyance passageways 14 and the reduced electrolyte circulation within the zone of location of the separator plate 9 practically rules out chlorine blowout into the magnesium collecting cell 10 and return of magnesium from the latter into the group 11 of electrolytic cells.

Some other embodiments of constructional arrangement of the diaphragmless electrolyzer are also practicable according to the invention, wherein the principal components thereof are similar to those described above and operate substantially as described in the aforementioned embodiment of the invention.

Figure 4:
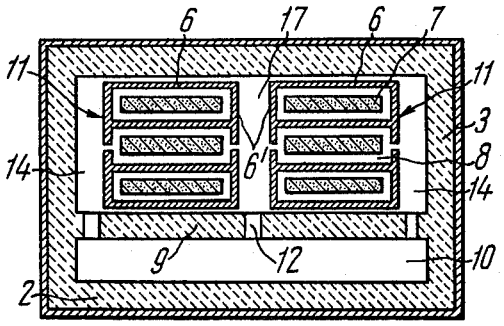
FIG. 4 is a top view of the electrolyzer with an additional passageway for magnesium conveyance sectionalized longitudinally with a horizontal plane at the level of through perforations in the separator plate.

Thus, according to another embodiment of the invention, the diaphragmless electrolyzer may have at least one more passageway 17 (FIG. 4) to convey magnesium from the groups 11 of electrolytic cells into the magnesium collecting cell 10. This makes it possible to have only three magnesium conveyance passageways for two groups 11 of electrolytic cells. The additional passageway 17 is formed by the portions 6' of the steel cathodes 6 of the adjacent groups 11 of electrolytic cells.

In such a diaphragmless electrolyzer magnesium is withdrawn from the interelectrode gap 8 in each of the groups 11 of electrolytic cells into the corresponding passageway 14 and the additional passageway common to both of said groups 11 of electrolytic cells.

Such an embodiment of the diaphragmless electrolyzer renders it possible to increase its productive efficiency by using a higher number of the groups 11 of electrolytic cells and to have only one magnesium collecting cell 10 adjacent to the longitudinal wall 2 of the shell thereof.

Figure 5:
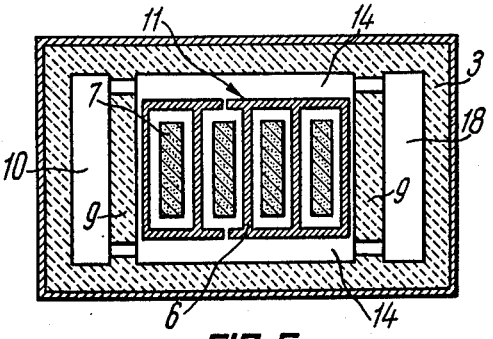
FIG. 5 is a top view of the electrolyzer with an additional magnesium collecting cell.

According to the third embodiment of the invention, the diaphragmless electrolyzer comprises an additional magnesium collecting cell 18 (FIG. 5) confined between the end wall 3 and the additional separator plate 9.

Each of the passageways 14 communicates both with the magnesium collecting cell 10 and with the additional magnesium collecting cell 18.

In said diaphragmless electrolyzer magnesium is conveyed along the passageways 14 into two magnesium collecting cells (10 and 18) at the same time.

Such an embodiment of the diaphragmless electrolyzer makes it possible to increase its productive efficiency with the provision of one group 11 of electrolytic cells comprising a higher number of graphite anodes 7 and steel cathodes 6.

Figure 6:
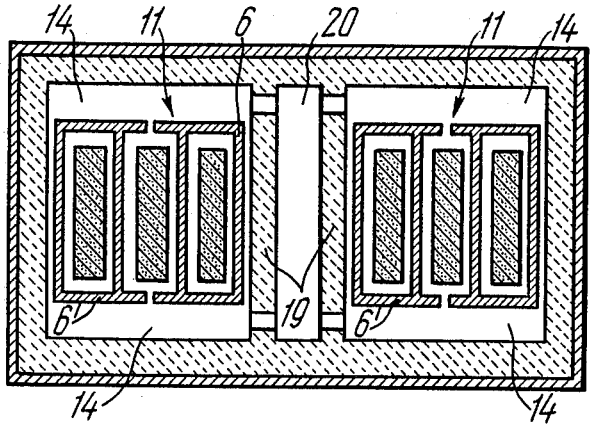
FIG. 6 shows the electrolyzer, wherein two pairs of magnesium conveyance passageways communicate with the magnesium collecting cell common to both.

According to the fourth embodiment of the invention, the diaphragmless electrolyzer has two groups 11 (FIG. 6) of electrolytic cells between which are positioned two separator plates 19 to confine the magnesium collecting cell 20 therebetween, with which are communicated the pairs of passageways 14 of each of the groups 11 of electrolytic cells.

The common magnesium collecting cell 20 is confined between the two separator plates 19 located between the steel cathodes 6 of the two adjacent groups 11 of electrolytic cells.

In such an electrolyzer magnesium is extracted from the two groups 11 of electrolytic cells along two pairs of passageways 14 into a single magnesium collecting cell 20 common to both groups.

Such an embodiment of the diaphragmless electrolyzer makes it possible to increase its productive efficiency and to concentrate magnesium collection in a single cell 20 interposed between the two groups 11 of electrolytic cells.

Figure 7:
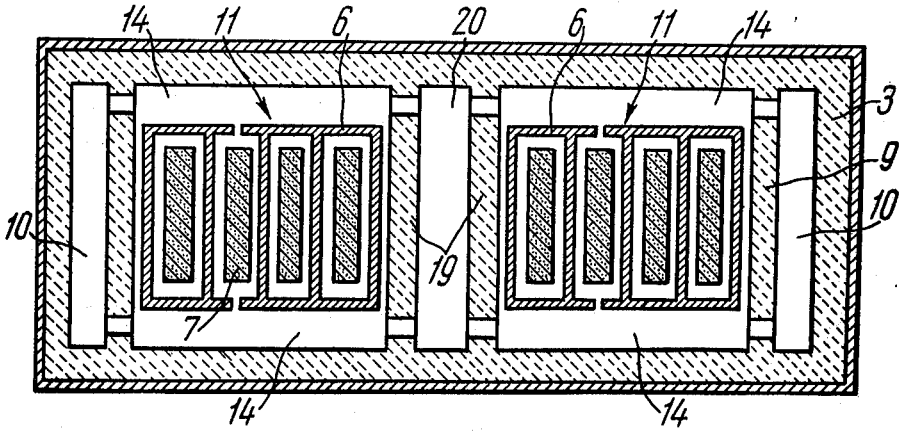
FIG. 7 shows the electrolyzer, wherein each of the pairs of magnesium conveyance passageways communicates with its own particular magnesium collecting cell and with the magnesium collecting cell common to it and to the adjacent pair of passageways.

According to the fifth embodiment of the invention, the diaphragmless electrolyzer has two groups 11 (FIG. 7) of electrolytic cells and, apart from the magnesium collecting cell 20 common to both of the groups 11 of electrolytic cells, it comprises also the magnesium collecting cells 10 particular for each of the groups 11 of electrolytic cells. These individual magnesium collecting cells 10 are confined between the separator plates 9 and the end walls 3 of the shell 1 of the diaphragmless electrolyzer.

In such an electrolyzer magnesium is discharged from the two groups 11 of electrolytic cells into the magnesium collecting cells 10 and 20 in both directions at the same time.

Such an embodiment of the diaphragmless electrolyzer makes it possible to increase its productive efficiency not only due to the provision of the two groups 11 of electrolytic cells therein, but also owing to the higher number of graphite anodes 7 and steel cathodes 6 in each of said groups.

According to the sixth embodiment of the invention, the diaphragmless electrolyzer has the groups 11 of electrolytic cells (FIG. 8) arranged in a row.

In said electrolyzer a pair of passageways 14 of each of the groups 11 of electrolytic cells is communicated with at least one magnesium collecting cell 20 common to the two adjacent groups 11 of electrolytic cells.

In such an electrolyzer magnesium is extracted along the passageways 14 from the groups 11 of electrolytic cells arranged in a row into the magnesium collecting cells 20 common to each pair of passageways 14 of the adjacent groups 11 of electrolytic cells.

Such an embodiment of the diaphragmless electrolyzer makes it possible to considerably increase its productive efficiency due to the higher number of the groups 11 of electrolytic cells and due to the provision of a greater number of graphite anodes 7 and steel cathodes 6 in those groups 11 of electrolytic cells wherefrom magnesium is extracted into two magnesium collecting cells 20 at the same time.

According to the seventh embodiment of the invention the diaphragmless electrolyzer incorporates groups 11 (FIG. 9) of electrolytic cells that are arranged in a row. A pair of passageways 14 in each of the groups 11 of electrolytic cells communicates with the magnesium collecting cell 20 common to the two adjacent groups 11.

In addition, each pair of passageways 14 in the groups 11 of electrolytic cells situated at the extreme ends of the row is also communicated with its own particular magnesium collecting cells 10 formed by the end walls 3 of the shell 1 of the electrolyzer and by the separator plates 9. In such a diaphragmless electrolyzer magnesium is discharged from each group 11 of electrolytic cells into two magnesium collecting cells (10 and 20) in both directions at the same time.

Such an embodiment of the diaphragmless electrolyzer makes it possible to increase its productive efficiency due to an increased number of the groups 11 of electrolytic cells and of graphite anodes 7 and steel cathodes 6 in each of said groups.

The afore-discussed exemplary embodiments of the diaphragmless electrolyzer illustrate every possibility of increasing its productive efficiency with its high economic indices remaining unaffected.

Thus, the diaphragmless electrolyzer disclosed in exemplary embodiments 2, 3, 4 and 5 can be designed for an amperage 2 to 2.5 times that of the known diaphragmless electrolyzers.

Further increase of the effective electrolyzer amperage to 400 to 500 kA involves the arrangement of the groups 11 of electrolytic cells of an electrolyzer in a row as described in embodiments 6 and 7.

Selection of an embodiment of the diaphragmless electrolyzer depends upon the specific installation conditions and the construction of the current leading system for cathodes and anodes.

Positioning of the magnesium collecting cells between the groups of elecctrolytic cells or at the walls of the electrolyzer shell depends upon the temperature conditions, electrolyte temperature and its proximity to the melting point of magnesium.

The diaphragmless electrolyzer rated for an amperage of 150 kA has passed industrial trial runs and has shown the following performance data:

current yield amounts to 85–87 percent;

electric power consumption is reduced to 13 thousand kilowatts per ton of magnesium, losses of chlorine are cut down to 10 kg per ton of mangesium.

Furthermore, its maintenance is much simpler and labor conditions are better, as the cathode frames prove to be highly durable.

In such an electrolyzer the provision of the magnesium conveyance passageways 14 contributes to good contact of the entire surface of the steel cathodes 6 with the electrolyte 13 which balances the temperature of all portions of the cathode frames, precludes their deformation and adds to the electrolyzer service life.

Provision of the two passageways 14 and magnesium extraction from the interelecctrode gaps 8 in two opposite directions renders it possible to make the anodes wider and to reduce their number without affecting the productive efficiency of the electrolyzer. This diminishes the production costs of the electrolyzer and its maintenance expenses involved in replacement of the graphite anodes.

Moreover, this improves labor conditions due to lower losses of chlorine and less frequent replacement of the graphite anodes.

Reduced amounts of chlorine in the sanitation exhaust gases reduce expenditures for construction of gas-purifying arrangements. Apart from all said hereinabove, one of the cardinal merits of the diaphragmless electroyzer under discusstion resides in its unlimited productive efficiency for, say, an amperage of 500 kA, in combination with the advantages considered hereinbefore.

As can be seen from the above-mentioned exemplary embodiments of the diaphragmless electroyzer, an increase in the productive efficiency thereof is attainable by increasing the area of the graphite anodes 7 and the steel cathodes 6. This is practicable when increasing the number of anodes or their width, or both.

When magnesium is withdrawn from each interelectrode gap along two magnesium conveyance passageways, the width of the graphite anodes can reach 3 *m* which is 1.5 to 2 times the width of the graphite anodes in the known diaphragmless electrolyzers. This results in a 1.5 to 2 times increase in the productive efficiency of the diaphragmless electrolyzer, with the number of graphite anodes and steel cathodes remaining the same.

The number of graphite anodes and steel cathodes per group of electrolytic cells governs the length of the passageways for magnesium conveyance from the group of electrolytic cells into the magnesium collecting cell.

For timely and fast magnesium extraction along the passageways and reliable and correctly directed electrolyte circulation, the length of the passageways in the diaphragmless electrolyzer should not exceed a present one.

With a great number of graphite anodes and steel cathodes per group of electrolytic cells and with relatively long passageways along which magnesium is conveyed into a single collecting cell, a stagnant zone is liable to occur at the passageway ends opposite the magnesium collecting cell, which impairs the supply of fresh electrolyte portions to electrolytic cells. Moreover, the path of magnesium to its collecting cell becomes longer, which results in partial chlorination of the magnesium, adversely affects current yield and abnormally increases electric power consumption.

All of this should be taken into account when constructing the diaphragmless electrolyzer according to the present invention; in addition, one should bear in mind that the number of graphite anodes and steel cathodes per group of electrolytic cells may be increased only in the case where each pair of magnesium conveyance passageways communicates with two magnesium collecting cells.

What is claimed is:

1. A diaphragmless electrolyzer for producing magnesium and chlorine, comprising: a refractory-lined shell having a compartment for electrolyte defined between a bottom, walls and a covering of said shell; a chlorine discharge outlet fixed on said electrolyzer shell; graphite anodes arranged in groups in said electrolyzer shell, each of said anodes being shaped as a rectangular plate; steel cathodes accommodated in said electrolyzer shell, each of said cathodes being shaped as a frame which forms an enclosure around each of said graphite anodes and defines a gap between said cathode and said anode; a group of electrolytic cells, each of said electrolytic cells being confined between the surfaces of an adjacent graphite anode and steel cathode; at least one vertical refractory separator plate adjoining the covering and walls of the electrolyzer but being shorter in height than the walls of said electrolyzer shell, said separator plate being arranged parallel to said graphite anodes and being adapted to isolate the magnesium collecting cell from the group of electrolytic cells, said separator plate having through perforations situated below the electrolytic level; at least two magnesium conveyance passageways, each of them being arranged at substantially right angles to said graphite anodes and to said separator plate and being confined between the wall of said shell of the diaphragmless electrolyzer and the portion of said steel cathode that faces towards the magnesium collecting cell said passageways having a width which is a maximum of three times the width of said gap between said adjacent graphite anode and steel cathode in each electrolytic cell.

2. A diaphragmless electrolyzer as claimed in claim 1, wherein at least one additional magnesium conveyane passageway is provided, said passageway being arranged substantially parallel to said magnesium conveyance passageways and being confined between said steel cathodes of the adjacent groups of electrolytic cells.

3. A diaphragmless electrolyzer as claimed in claim 1, wherein each of said magnesium conveyance passageways communicates with an additional magnesium collecting cell confined between the wall of said electrolyzer shell and an additional separator plate.

4. A diaphragmless electrolyzer as claimed in claim 2, wherein each of said magnesium conveyance passageways communicates with an additional magnesium collecting cell confined between the wall of said electrolyzer shell and an additional separator plate.

5. A diaphragmless electrolyzer as claimed in claim 1, wherein the passageways of one group of electrolytic cells and the passageways of another group of electrolytic cells communicate with a magnesium collecting cell commn to both, said magnesium collecting cell being defined by two separator plates provided between the cathodes of adjacent groups of electrolytic cells.

6. A diaphragmless electrolyzer as claimed in claim 5, wherein the passageways of each group of electrolytic cells are additionally communicated with their own particular magnesium collecting cell, each of said magnesium collecting cells being confined between the corresponding separator plate and the wall of said shell of the diaphragmless electrolyzer.

7. A diaphragmless electrolyzer as claimed in claim 1, wherein groups of electrolytic cells are arranged in a row, and the passageways of a group of electrolytic cells communicate with at least one magnesium collecting cell confined between the separator plates and serving as a common cell for said passageways and for the passageways of an adjacent group of electrolytic cells.

8. A diaphragmless electrolyzer as claimed in claim 7, wherein the passageways of the groups of electrolytic cells located at the extreme ends of the row communicate with their own particular magnesium collecting cells confined between the wall of said electrolyzer shell and the additional separator plate.

* * * * *